United States Patent [19]

Unique

[11] 4,143,878

[45] Mar. 13, 1979

[54] THREE DIMENSIONAL BALL GAME DEVICE

[76] Inventor: Ervin L. Unique, P.O. Box 99, Terang, Australia, 3264

[21] Appl. No.: 826,763

[22] Filed: Aug. 22, 1977

[30] Foreign Application Priority Data

Aug. 26, 1976 [AU] Australia ..... 7167/76

[51] Int. Cl.[2] ..... A63F 3/00

[52] U.S. Cl. ..... 273/241; 273/271; 273/280

[58] Field of Search ..... 273/241, 271, 280, 282, 273/287; 312/326; 220/336

[56] References Cited

U.S. PATENT DOCUMENTS

| | | | |
|---|---|---|---|
| 378,208 | 2/1888 | Mitchell | 220/336 X |
| 589,463 | 9/1897 | Case | 312/463 |
| 663,249 | 12/1900 | Whitman | 273/282 |
| 1,441,386 | 1/1923 | Truskoski | 273/282 |
| 1,683,860 | 9/1928 | Cahill | 273/282 X |
| 2,880,001 | 3/1959 | Rosenzweig | 273/241 |
| 3,113,778 | 12/1963 | Silverman | 273/280 X |
| 3,464,701 | 9/1969 | Mahoney | 273/241 |
| 3,851,885 | 12/1974 | Pepkowski et al. | 273/287 |
| 3,879,040 | 4/1975 | Smith | 273/283 X |

FOREIGN PATENT DOCUMENTS

| | | | |
|---|---|---|---|
| 6702022 | 5/1968 | Netherlands | 312/326 |

*Primary Examiner*—Anton O. Oechsle
*Attorney, Agent, or Firm*—Brisebois & Kruger

[57] ABSTRACT

A toy has three or more ball housing elements for two or three different colored balls. Inside of each of the ball housing elements the inner vertical partitions form the space into nine separate compartments within the ball housing elements which contain the two or three different colored balls in the separate compartments. All the compartments have equal length, width and height.

3 Claims, 3 Drawing Figures

THREE DIMENSIONAL BALL GAME DEVICE

BACKGROUND OF THE INVENTION

The present invention relates genrally to toys and, more particularly, to a toy having a playing action and reaction produced on a changeable surprise and random basis so that there is a considerable element or factor of surprise contributing to the high play value of the toy.

SUMMARY OF THE INVENTION

As generally understood, the play value of a toy can in many instances be supplemented by introducing a surprise element or factor in the operating of the toy. In this case there is a constant surprise element or factor, operating by the random reaction of the opponents move. Thus, for example, in the present toy it is more appealing if the balls with the chosen colors, by the opposing players, are dropped IN; into the self selected separate compartments occurs on a surprise and random basis, and constantly surprises the opponent user of the toy. However, this surprise and random operation of the toy cannot be permitted to increase the compexity of the parts, the assembly or the mode of operation of the toy.

Broadly it is an object of the present invention to provide a surprise and random operating toy having a simple construction and mode of operation. Specifically, it is an object to provide a toy having a randomly operating continuous surprise element in which the randomness is readily and effectively achieved by merely dropping IN the balls with the chosen colours into the self selected separate compartments by the opposing players.

BRIEF DESCRIPTION OF THE DRAWINGS

The invention will now be described, by way of example, with reference to the accompanying drawings, in which.

DETAILED DESCRIPTION OF THE INVENTION

Figure 1:
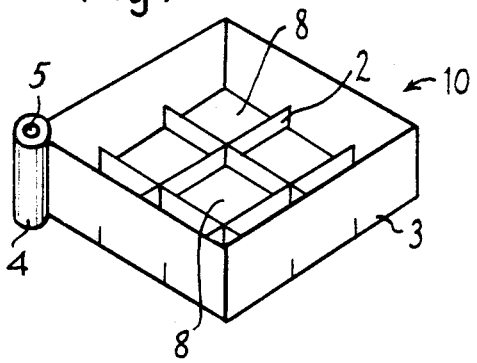
FIG. 1 is a perspective view of one embodiment of ball housing element with inside partitions which are one third of the height of the outside walls, and which defines separate square compartments.

Referring to the drawings, a toy comprises upwardly open square box-shaped ball housing elements 10. Each ball housing element has sides of about one and a half inches in length and is made of transparent plastics. Each ball housing element is provided with inner partitions 2 in such a manner as to divide it into nine square compartments 8 having equal sides of a half an inch. The partitions need only be one third of the height of the outside wall 3 which is about half an inch in height. These sizes are given for easier understanding and shown for purposes of illustration, but are not intended to be limiting.

Each ball housing element 10 is provided on the outside wall of one corner with a coupling hinge 4 having an aperture 5 serving to facilitate coupling the three ball housing elements together. A square cover plate 7 corresponding in size to the ball housing elements also has at one of its corners a coupling hinge 4 with an aperture 5 to enable the cover plate to be connected with the ball housing elements to form a top cover plate. By inserting a pin 6 through the apertures 5 of all the coupling hinges 4 when aligned the ball housing elements and the cover plate 7 can be connected and fastened together.

This will enable the ball housing elements 10 to be swung horizontally to the open position and so enable different colored balls to be put into selected compartments 8 by the opposing players. After one player has dropped the ball into a self selected compartment 8 and has swung back the ball housing element 10 into the closed position, the ball housing elements are then passed over to an opponent player. This procedure is repeated until all the balls are placed in the square zones 8.

The ball housing elements 10 are constructed so that the dimensions of each ball housing element FIG. 1 is a multiple of a given basic module or compartment 8 and also that the said basic modules or compartments 8 have the same dimensions and are spaced equally in length and width in all the ball housing elements. The different models and numbers of such basic modules or compartments 8 are simply decided according to their final vertical size. If the latter is 3 units high then $3 \times 3$, if it is 5 units height then $5 \times 5$.

Figure 3:
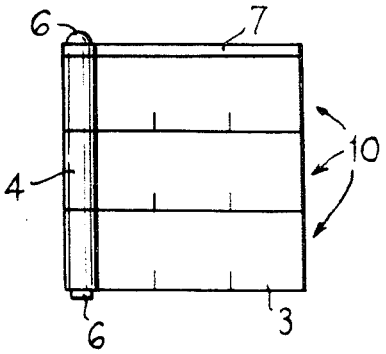
FIG. 3 is a side view of the complete set shown in FIG. 2 including a pin which allows the elements and cover plate to be swung horizontally.
Figure 2:
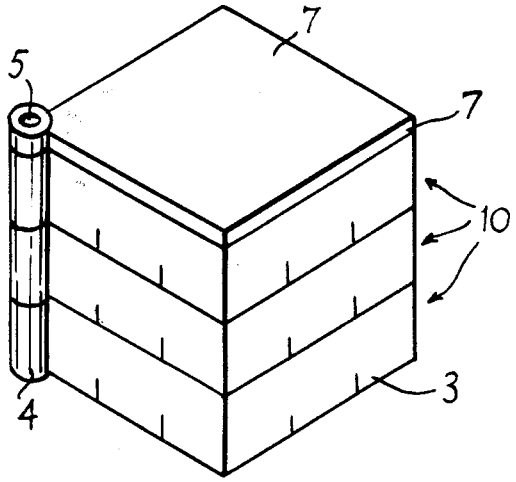
FIG. 2 is a perspective view of three ball housing elements and a top cover plate making a playable set.

When making a set of ball housing elements, FIG. 3, from such ball housing elements it may in certain cases be of interest to use larger models and the correspondingly multiple number of ball housing elements other than the normal and basic $3 \times 3 \times 3$ basic module compartment 8. The ball housing elements must contain a greater number of basic modules or compartments 8 in length and width. Correspondingly the number of ball housing elements must be increased vertically to the same number as the length or width of the horizontal number of basic modules or compartments 8. With increased number of basic modules or compartments the actual size of the latter should be decreased.

I claim:

1. A three dimensional ball game device comprising:

a plurality of open-topped, substantially square, box-shaped ball housing elements formed from transparent plastics material and stacked one upon another to form a rectangular block structure, each of said ball housing elements including partitions which divide the ball housing element into compartments of equal length and width and of about one third the height of the ball housing element, each ball housing element having hinge means adjacent one of its corners, a substantially square cover plate formed from transparent plastics material located above the upper most ball housing element, said cover plate having hinge means adjacent one of its corners, said hinge means on said ball housing elements and said top cover plate comprising aligned apertures extending therethrough and pin means extending through said apertures to connect the ball housing elements and top cover plate together, whereby the ball housing elements and top cover plate can be swung about the pin means with respect to one another, and the cover plate can be swung over the upper ball housing element, coloured balls located in one or more of the compartments in the ball housing elements.

2. A device according to claim 1 comprising more than four ball housing elements.

3. A device according to claim 1, wherein the dimensions and number of the individual ball housing elements are such that the stack of ball housing elements forms a cube structure.

* * * * *